US005377515A

United States Patent [19]

Baensch

[11] Patent Number: 5,377,515

[45] Date of Patent: Jan. 3, 1995

[54] PROCESS FOR COLD PILGER ROLLING OF THIN-WALLED PIPES

[75] Inventor: Michael Baensch, Mönchengladbach, Germany

[73] Assignee: Mannesmann Aktiengesellschaft, Dusseldorf, Germany

[21] Appl. No.: 127,868

[22] Filed: Sep. 28, 1993

[30] Foreign Application Priority Data

Sep. 30, 1992 [DE] Germany ..... 4233556

[51] Int. Cl.[5] ..... B21B 1/42; B21B 37/10

[52] U.S. Cl. ..... 72/13; 72/200; 72/214; 72/342.8; 72/370

[58] Field of Search ..... 72/200, 208, 209, 214, 72/342.7, 342.8, 342.92, 342.94, 342.96, 370, 13

[56] References Cited

U.S. PATENT DOCUMENTS 3,147,725 9/1964 Tribe ..... 72/342.96

3,670,549 6/1972 Tselikov et al. ..... 72/214

*Primary Examiner*—Lowell A. Larson

*Assistant Examiner*—Thomas C. Schoeffler

*Attorney, Agent, or Firm*—Cohen, Pontani, Lieberman, Pavane

[57] ABSTRACT

A process for cold pilger rolling of thin-walled pipes having small outer diameters in which calibrated rolls are moved along the intermittently stationary pipe, inside of which a roll mandrel which is likewise calibrated assists in the shaping of the inner and outer pipe in the shaping region. To produce pipes which are thinner and have thinner walls than was formerly possible, the pipe to be shaped and the shaping tools (rolls and roll mandrel) are warmed up to operating temperature before and/or during the starting rolling phase of the pipes to be shaped.

6 Claims, No Drawings

PROCESS FOR COLD PILGER ROLLING OF THIN-WALLED PIPES

BACKGROUND OF THE INVENTION

1. Field of the Invention

The invention is directed to a process for cold pilger rolling of thin-walled pipes having small outer diameters in which calibrated rolls are moved along the intermittently stationary pipe, inside of which a roll mandrel which is likewise calibrated assists in the shaping of the inner and outer pipe in a deformation or shaping region.

2. Description of the Prior Art

In cold pilger rolling of pipes, pipes having a large outer diameter are shaped into pipes with a smaller outer diameter. In so doing, calibrated rolls which are supported in a reciprocating roll stand are moved along the momentarily stationary pipe and deformed in a known manner when the groove rolls over the pipe. An internal tool, the roll mandrel, which is likewise calibrated ensures that the inner diameter and the pipe wall follow the desired regularity along the shaping distance.

The cold pilger rolling process has been known for a long time and has proven successful throughout the world as a process for producing pipes from various metals and metal alloys. Because of the particularly high quality of pipes produced by this process, there has been an increasing demand over recent years to produce small thin-walled precision pipes of high-quality steels and other high-strength materials by cold pilger rolling as well. Such precision pipes are conventionally produced by less cost-intensive shaping processes, e.g. drawing. Due to the steadily growing demand for quality, cold pilger rolling, at least as a final shaping step for these products, also has economic significance.

However, problems relating specifically to dimensions arise in cold pilger rolling of thin-walled pipes. Naturally, for very thin pipes the required internal tool, i.e. the roll mandrel, is correspondingly thin. The longitudinal forces and bending moments acting on the roll mandrel in cold pilger rolling therefore cause greater stress on the mandrel tool in these thin finished pipes and must be taken into account.

The influence of the effective forces is further increased when thin-walled pipes are to be produced. In this case, the deformation force applied by the rolls acts on the roll mandrel through the thin pipe wall. The thinner the pipe wall, the poorer the supporting action of the pipe. In the case of thick-walled pipes, this supporting action is capable of absorbing most of the shaping force applied by the rolls.

Due to these physical laws, the loading of the roll mandrel sets limits for the use of cold pilger rolling for the production of thin pipes and thin-walled pipes. Damage to the shaping tools, which cannot withstand the high forces, has been known to occur particularly at the start of the rolling process.

DESCRIPTION OF THE INVENTION

In view of the problems described above, it is an object of the present invention to provide a process whereby the limits imposed by the rolling process may be lifted so that pipes can be produced which are thinner and have thinner walls than was previously possible.

Pursuant to this object, and others which will become apparent hereafter, one aspect of the present invention resides in warming up the pipe to be shaped and the shaping tools (i.e. the rolls and roll mandrel) to an operating temperature before and/or during the starting rolling phase for the pipe to be shaped.

This is based on the insight that tile stress on the cold shaping tools is particularly great in tile starting phase, even though tile pipe is still cold and accordingly harder to deform. These differences in temperature relative to tile operating temperature, even when only slight, are sufficient to damage tile tools and accordingly to exclude or limit the application of cold pilger rolling for particularly thin and thin-walled pipes. The troublesome differences in temperature occurring at the start of tile shaping process are avoided and the stresses on the tools are accordingly reduced in that during or already before the starting rolling phase tile shaping tools and the pipe are brought to the temperature which would first occur during the shaping process as a result of tile shaping forces. This makes it possible to produce thinner pipes and thick-walled pipes at tile same time.

In a particularly advantageous embodiment of the invention a roll gap that is larger than that used during tile working phase is used to shape in the starting rolling phase and the roll gap is continuously adjusted to its final dimension during tile starting rolling phase.

This is based on the idea that the excessive stress of the shaping tool, particularly the roll mandrel, is reduced when the rolls, the roll mandrel and the pipe located between the rolls are warmed up by a careful starting rolling. This means that for the first length of pipe to be rolled, e.g. 1,000 mm, the roll gap is deliberately adjusted so as to be too large so that the outer diameter and wall thickness of the finished pipe are indeed greater than desired, but the roll mandrel is loaded only slightly in so doing. Immediately after this "warm-up rolling", the roll gap can be reset to the correct magnitude and the thin, thin-walled pipe is rolled out.

According to a further embodiment of the invention, the pipe and shaping tools can be warmed up by supplying heat from external heat sources. In yet another embodiment, the operating temperature is reached while being monitored by measuring techniques and a measurement signal can be used for controlling the roll gap adjustment or the supply of heat.

The problems mentioned above, which occur when cold pipes are rolled with cold tools, are avoided as a result of the process steps according to the invention. The "warm-up rolling" with slight forces acting on the mandrel avoids operation with high rolling forces in a cold state which is critical for the mandrel, since the work materials employed for thin roll mandrels are sensitive to high pressure forces in the cold state. Also, the warmed up pipe can be shaped with less expenditure of force, i.e. the forces occurring between the rolls and the pipe are smaller. Since these forces decisively influence the pressure forces on the mandrel, the stresses on the roll mandrel are also lower.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

I claim:

1. A process for cold pilger rolling of a thin-walled pipe having a small outer diameter, comprising:

providing shaping tools inside and outside the pipe;

warming up the pipe and the shaping tools to an operating temperature;

shaping the pipe by moving the shaping tools arranged outside the pipe along the pipe as the pipe is held intermittently stationary.

2. A process for cold pilger rolling of a thin-walled pipe having a small outer diameter, comprising the steps of:

moving calibrated rolls along the pipe as it is held intermittently stationary;

providing a roll mandrel, which is likewise calibrated, inside the pipe to assist in shaping inner and outer walls of the pipe in a shaping region; and warming up the pipe, the rolls and the roll mandrel to an operating temperature at least one of before and during a starting rolling phase of the pipe.

3. A process according to claim 2, including using a roll gap during a working phase of the rolling which is larger than a roll gap in the starting rolling phase, and continuously adjusting the rolling gap to a final magnitude during the starting rolling phase.

4. A process according to claim 3, and further comprising the steps of monitoring the operating temperature and controlling the roll gap adjustment based upon the monitored operating temperature.

5. A process according to claim 2, wherein the warming step includes warming up the pipe and the rolls and the roll mandrel by supplying heat from external heat sources.

6. A process according to claim 5, and further comprising the steps of monitoring the operating temperature and controlling the supply of heat based upon the monitored operating temperature.

* * * * *